US009113724B1

(12) United States Patent
Heining et al.

(10) Patent No.: US 9,113,724 B1
(45) Date of Patent: Aug. 25, 2015

(54) SYSTEM FOR CREATING DECORATIVE ARCHES AND COLUMNS

(71) Applicant: Glass House Balloon Co., Inc., Anaheim, CA (US)

(72) Inventors: Treb Heining, Anaheim, CA (US); William Schaffell, Anaheim, CA (US)

(73) Assignee: GLASS HOUSE BALLOON CO., INC., Anaheim, CA (US)

( * ) Notice: Subject to any disclaimer, the term of this patent is extended or adjusted under 35 U.S.C. 154(b) by 0 days.

(21) Appl. No.: 14/711,530

(22) Filed: May 13, 2015

Related U.S. Application Data

(63) Continuation of application No. 14/327,418, filed on Jul. 9, 2014, now Pat. No. 9,051,755.

(60) Provisional application No. 61/847,013, filed on Jul. 16, 2013.

(51) Int. Cl.

| | |
|---|---|
| ***A47F 7/00*** | (2006.01) |
| ***G09F 21/06*** | (2006.01) |
| ***E04B 1/32*** | (2006.01) |
| ***A63H 27/10*** | (2006.01) |
| ***E04H 12/22*** | (2006.01) |
| ***E04H 15/36*** | (2006.01) |

(52) U.S. Cl.
CPC *A47F 7/00* (2013.01); *A63H 27/10* (2013.01); *E04B 1/32* (2013.01); *E04H 12/2253* (2013.01); *E04H 12/2261* (2013.01); *E04H 15/36* (2013.01); *A63H 2027/1008* (2013.01); *A63H 2027/1041* (2013.01)

(58) Field of Classification Search
CPC ..... E04H 15/18; E04H 15/34; E04H 15/322; E04H 15/36; E04H 15/38; E04H 15/40; E04H 15/44; E04H 15/60; E04H 15/405; E04H 12/2238; E04H 12/2253; E04H 12/2261; E04H 12/22; E04H 2015/326; E04C 3/38; E04B 2001/3241; E04B 1/32; A63H 2027/1008; A63H 27/10; A45F 5/04; G09F 15/0056; G09F 15/0075; G09F 21/06; G09F 19/228; A47F 7/00; E01F 9/0124; B44C 1/00; B44C 5/00; Y10S 248/91
USPC ..... 52/40, 86, 848, 745.17; 40/607.1; 160/84.07, 350, 351; 248/176.1, 440.1, 248/910; 135/114, 124, 128, 136, 138; 446/220
See application file for complete search history.

(56) References Cited

U.S. PATENT DOCUMENTS

| | | | | |
|---|---|---|---|---|
| 2,032,030 | A | 2/1936 | Talen | |
| 3,119,588 | A | 1/1964 | Keats | |
| 3,857,213 | A | 12/1974 | Miyake | |
| 4,647,042 | A | 3/1987 | Bruce | |
| 4,953,713 | A * | 9/1990 | Yaffe | 211/13.1 |

(Continued)

FOREIGN PATENT DOCUMENTS

| | | |
|---|---|---|
| DE | 102010/007485 | 8/2011 |
| JP | 3183138 | 5/2013 |

*Primary Examiner* — Robert Canfield
(74) *Attorney, Agent, or Firm* — Cislo & Thomas, LLP

(57) ABSTRACT

A system for creating decorative arches and columns of balloons or fabric without the need of helium balloons. The system comprises a baseplate to provide a foundation, a mounting pin upon which a starter pole can be mounted, and a plurality of extension poles to attach to the starter pole to create a column or arch of a desired length. Regular balloons without the need for helium can be tied to the poles as decorations creating an arch or column of balloons.

20 Claims, 5 Drawing Sheets

(56) References Cited

U.S. PATENT DOCUMENTS

| | | | | |
|---|---|---|---|---|
| 5,036,985 | A * | 8/1991 | Lovik | 211/13.1 |
| 5,172,505 | A | 12/1992 | Borsella | |
| 5,345,962 | A | 9/1994 | Moss | |
| 5,441,069 | A | 8/1995 | Moss | |
| 5,904,258 | A * | 5/1999 | Farmer et al. | 211/206 |
| 6,015,138 | A | 1/2000 | Kohlberger et al. | |
| 6,286,531 | B1 | 9/2001 | Joo-Tai | |
| 6,308,468 | B1 * | 10/2001 | Caruso | 52/165 |
| 6,375,600 | B1 | 4/2002 | Mallette | |
| 6,450,187 | B1 * | 9/2002 | Lin et al. | 135/114 |
| 6,981,680 | B1 | 1/2006 | Gordon et al. | |
| 8,312,888 | B2 | 11/2012 | Rees, Jr. | |
| 2001/0045074 | A1 | 11/2001 | Kim | |
| 2003/0089390 | A1 | 5/2003 | Seo | |
| 2006/0175595 | A1 | 8/2006 | Carnevali | |
| 2009/0020146 | A1 * | 1/2009 | Bong | 135/114 |
| 2011/0030299 | A1 * | 2/2011 | Raynor | 52/295 |
| 2011/0218811 | A1 | 9/2011 | Li et al. | |
| 2012/0131879 | A1 | 5/2012 | Bergman | |
| 2013/0153737 | A1 | 6/2013 | Zoeteman | |
| 2013/0175422 | A1 | 7/2013 | Clarke et al. | |
| 2014/0117174 | A1 | 5/2014 | Tan et al. | |

* cited by examiner

SYSTEM FOR CREATING DECORATIVE ARCHES AND COLUMNS

CROSS-REFERENCE TO RELATED APPLICATION

This patent application is a continuation of U.S. patent application Ser. No. 14/327,418, filed on Jul. 9, 2014, which claims the benefit of U.S. Provisional Patent Application Ser. No. 61/847,013, entitled "System for Creating Decorative Arches and Columns," filed Jul. 16, 2013, which applications are incorporated in their entirety here by this reference.

TECHNICAL FIELD

This invention relates to a decoration assembly to hold balloons, decorative materials and the like.

BACKGROUND

Heretofore, architectural arches have been used to establish decorative structures of various types by attaching helium-filled balloons and fabric structures onto flexible supports.

In the case of balloon structures, balloons filled with helium are generally joined together on a rope or string attached to a simple ground fixture such as a stake or weight. In this system, because the difference in air density between the interior and exterior cavities of the balloon is substantial, an arch or vertical column of balloons forms naturally at most elevations.

Manufacturers of balloon arches and columns have attempted to construct balloon decorative structures containing atmospheric air-filled balloons, rather than expensive helium-filled balloons. Past attempts to create such structures have faced difficulty, however, due to the natural flexibility of the support structures employed, the instability of atmospheric balloon arch and vertical balloon column support structures, and the increasing expense of helium and other comparable pressurized gases. In addition, the skilled labor requirements for manipulating and maintaining balloon structures in a form free of tangles and knots has proven prohibitive. Thus, it is difficult to produce balloon decoration assemblies simply, quickly, and in a lasting manner using inexpensive gas media and conventional assembly techniques.

Therefore, there is still a need for a balloon and fabric decoration assembly formed by a plurality of balloon or fabric units which may be produced and assembled in a simple manner allowing maintenance of structural rigidity and balance under various conditions, producing an attractive appearance.

SUMMARY

The present invention is directed to a system of balloon and fabric decoration and its method of production that provides various structures that can be used in a stable fashion both indoors and outdoors.

It is the Object of the present invention to provide decorative structures that, unlike the traditional balloon arches, can be used indoors and outdoors without the use of helium balloons and other balloons containing comparable interior air density. The invention can be used to fasten balloons, fabric, and other materials in variety of structural forms including a large arch, multiple arches, circular structures, and vertical columns, and the like. Each structural form may be made larger with additional poles or kits. The different geometrical shapes the arches can take on are supported by strong base plates that can, optionally, be fastened to both indoor and outdoor floor structures. Interchangeable poles interlock to form joints, providing support and structural variety.

A further object of the invention is to provide a portable structure that can be decorated with floral arrangements, bells and strings of lights for illuminating the arch during a ceremony. The plurality of decorative elements that can be attached, in addition to the various achievable geometric forms of the invention, fill an increasing demand throughout the world for portable, safe structures that can be customized for different celebratory, ceremonial, athletic or business-oriented events.

A further object of the present invention is to provide a kit comprising a base plate, mounting pins, poles, and fasteners for quick and easy assembly and disassembly. Due to the stability and interchangeability of its pole segments, the method of assembly of the present invention enables the formation of very large and small structures. These structures are supported by the base plates containing a plurality of holes that may be used to secure the mounting pin upon which extension poles can be mounted. In some embodiments, the holes may be located in the center, on the sides, or on the corners of the base plate. Base plates can also be stacked upon one another to support outdoor structures and structures with large arches and columns.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the system, functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 7:
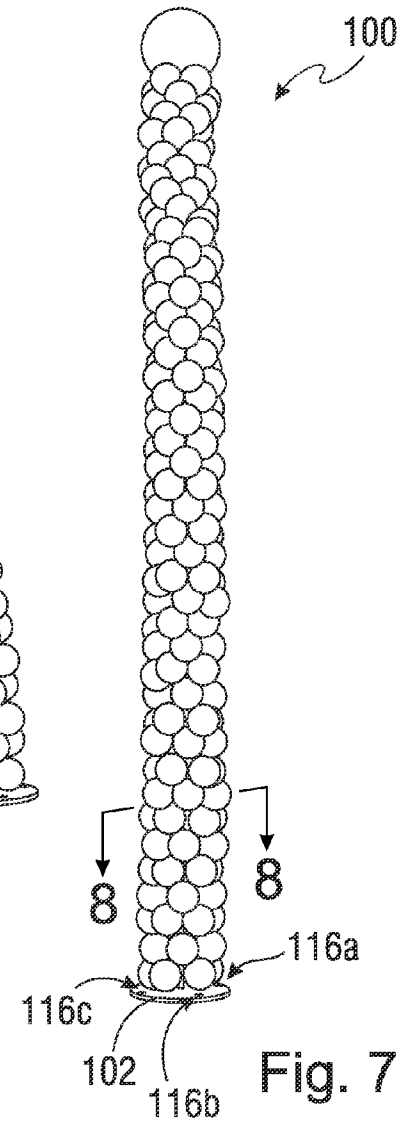
FIG. 7 is a perspective view of a decorative balloon column assembly.
Figure 6:
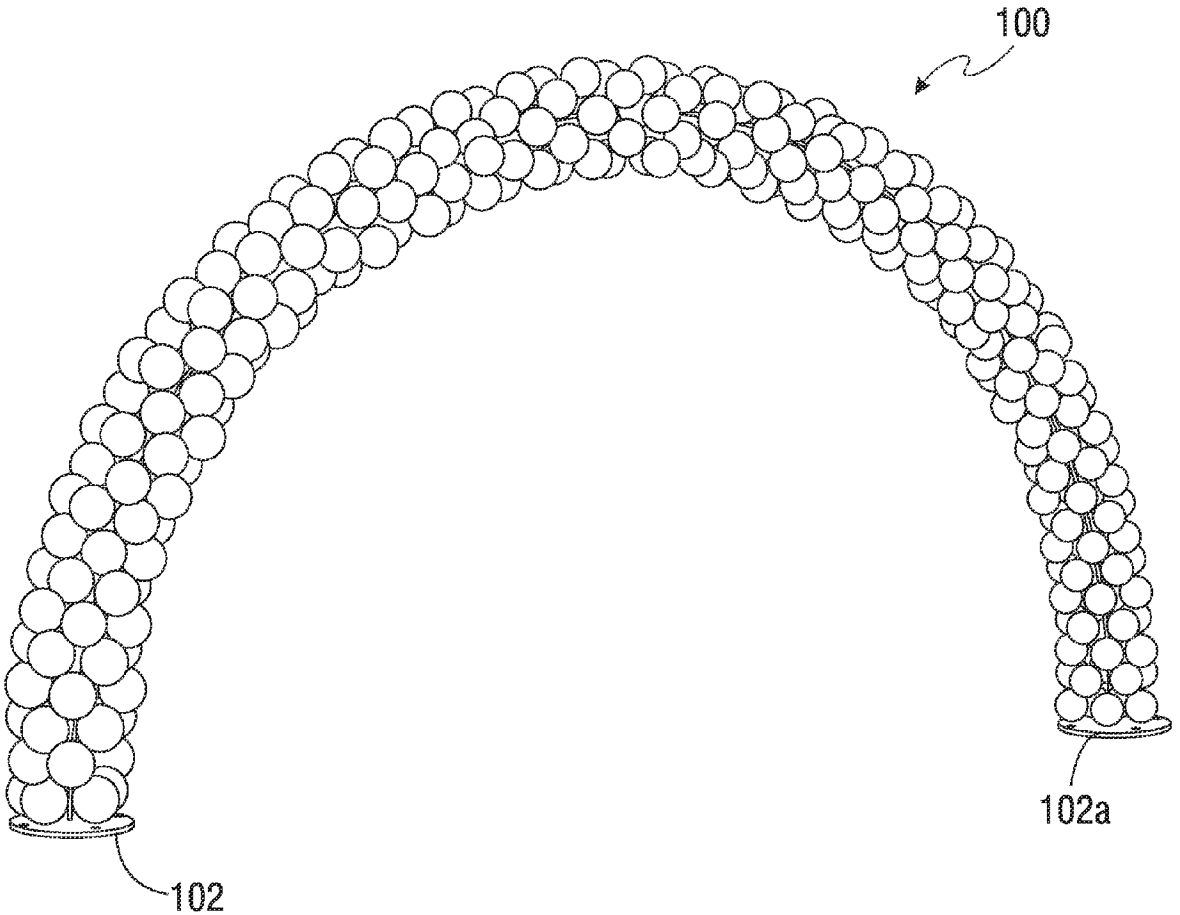
FIG. 6 is a perspective view of an embodiment of a decorative balloon arch assembly.

The invention of the present application is a decorative system 100 that is easy to assemble to create an arch or column of balloons without the use of helium, as shown in FIGS. 6 and 7. Further, because the respective balloon and fabric elements are supported by a rod structure and base plates, the invention facilitates support of non-helium balloons and the like while simplifying and expediting assembly and storage of the decorative system.

Figure 1:
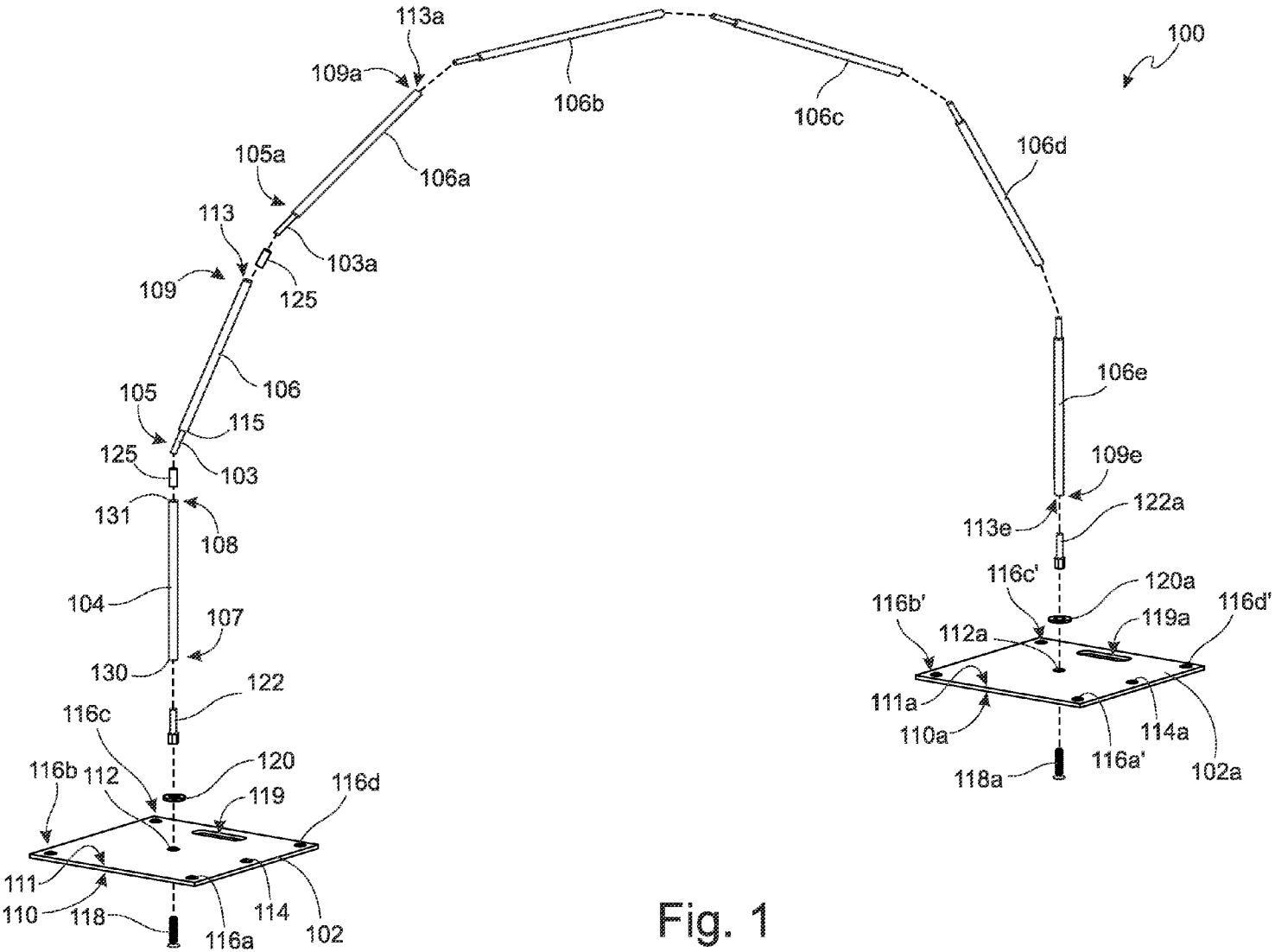
FIG. 1 is an exploded elevation view of an embodiment of the present invention.

As shown in FIG. 1, the decorative system 100 comprises at least one base plate 102, at least one starter pole 104, and a plurality of extension poles 106, 106*a-e*. The base plate 102 provides support for the various structures. The starter pole 104 may be fastened to the base plate 102 via a mounting pin 122 and provides the first link for the extension poles 106, 106*a-e*. A first extension pole 106 may be linked to the starter pole 104 and subsequent extension poles 106*a-e* may be linked to a previous extension pole to extend the length of the decorative system 100. More extension poles 106 may be used for larger arches.

The purpose of the base plate 102 is to provide structural support to the decorative system. 100 because exterior wind conditions, inadvertent human interactions with the decorative system 100, and even the weight of the poles, may cause imbalance during use. This rigid structure of the assembled decorative system 100 also provides support for the various large geometrical forms and combinations the arches can take on. Finally, because the base plates 102 are easily disassembled from the other components of the present invention, they provide a portable, safe structure that can be customized for different events.

Figure 2:
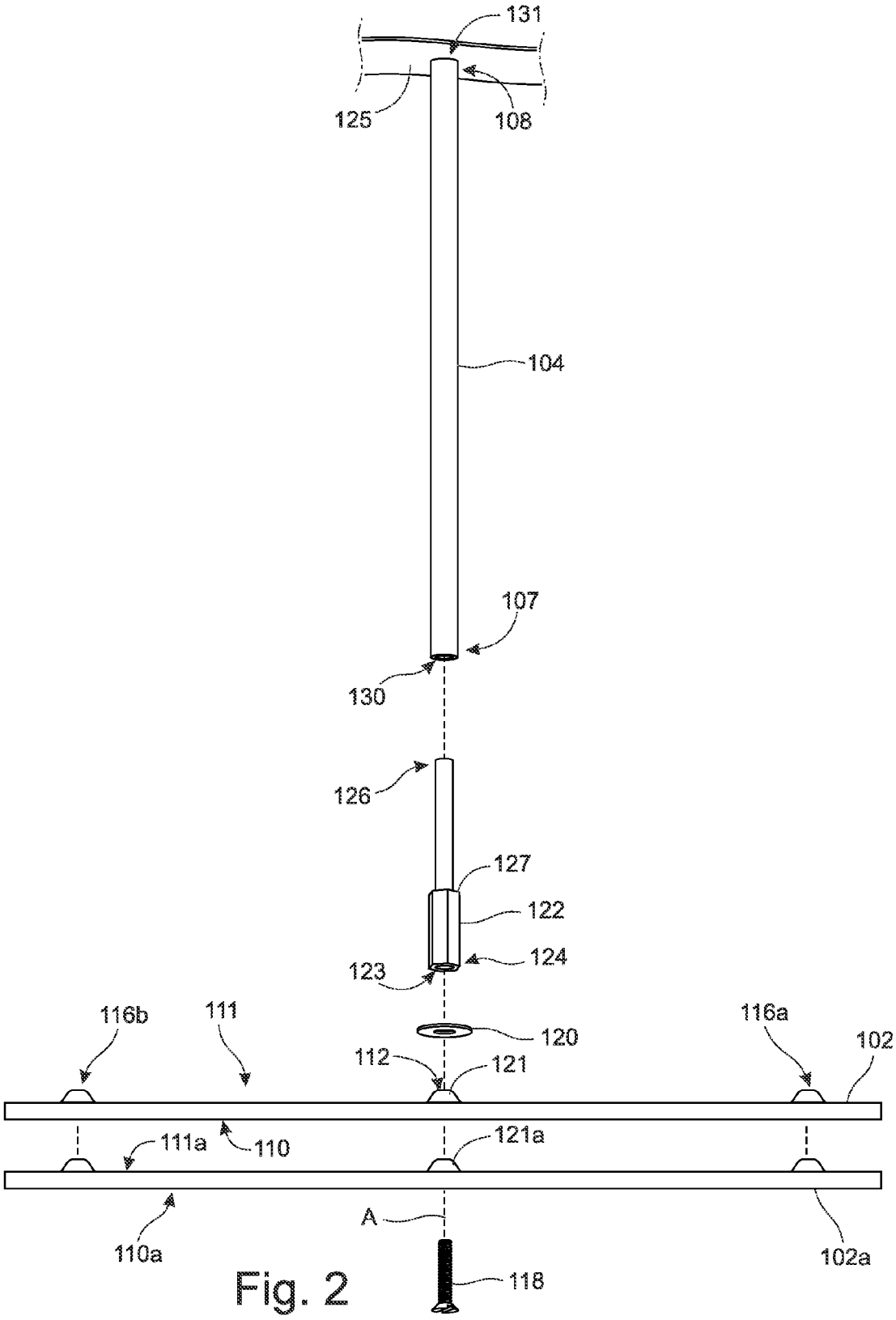
FIG. 2 is a close-up, exploded elevation view of a portion of an embodiment of the present invention.

In the preferred embodiment, as shown in FIG. 2, the base plate 102 is rectangular in shape having a top surface 111 and a bottom surface 110 opposite the top surface 111. However, the base plate 102 can take on any shape, such as oval, round, triangular, pentagon, and the like, so long as the baseplate 102 has a dimension and weight sufficient to support the desired number of extension poles 106. In some embodiments, the dimensions can be smaller if the base plate can be secured to a surface. The base plate 102 can be made of any structurally rigid material, such as metal, wood, plastic, and the like, or any combination thereof. Preferably, the base plate 102 is made of steel. In the preferred embodiment, the base plate 102 is heavy enough to provide a stable support mechanism to counter external forces. For example, in some embodiments, the base plate 102 may weigh 20 pounds or more. In some embodiments, the base plate may weigh 25 pounds or more. In some embodiments, the base plate 102 may weigh 30 pounds or more. In a preferred embodiment, the base plate 102 weighs 31 pounds.

In the preferred embodiment, the base plate 102 comprises a center hole 112 in addition to a plurality of auxiliary holes, including side holes 114, corner holes 116, any other holes along the outer perimeter or anywhere else on the base plate 102. A cutout 119 may also be provided for use as a handle for ease of transportation. A fastener 118 may be inserted through the holes on the bottom surface 110 to fasten a mounting pin 122 on the top surface 111 so that the mounting pin 122 is securely fastened to the base plate 102 perpendicular to the top surface 111. Due to the various placements of the holes, the mounting pin 122 can be attached to the base plate 102 at a variety of locations. A washer 120 may be used to facilitate the connection. In addition, these holes may enable fastening of the base plate 102 to wood, grass, dirt, or other ground surfaces to provide structural stability. Screws, nails, stakes, and the like can be inserted into any of the unused holes 112, 114, and 116*a-d* and into the ground, if desired.

As shown in FIG. 2, at least two base plates 102, 102*a* can be stacked, with the bottom surface 110 of one base plate 102 stacking upon the top surface 111*a* of a second base plate 102*a*. In this doubly-stacked formation, the mounting pin 122, washer 120 and fastener 118 secure to the base plate 102 in the same manner as described above. Preferably, any of the holes 112, 114, 116 may be defined by a raised protrusion 121. In the preferred embodiment, the raised protrusion 121 is frustoconical in shape to facilitate the stacking of one or more base plates 102. Thus, one frustoconical protrusion 121*a* can fit inside another frustoconical protrusion 121 as shown in FIG. 2. The base plates 102 may come in various shapes, sizes, and weights so as to incrementally change the total weight of a base as necessary to support arches of various heights.

Figure 3:
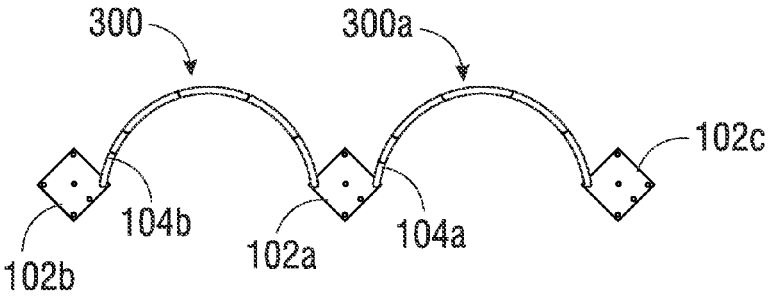
FIG. 3 is a top view of another embodiment of the present invention.
Figure 4:
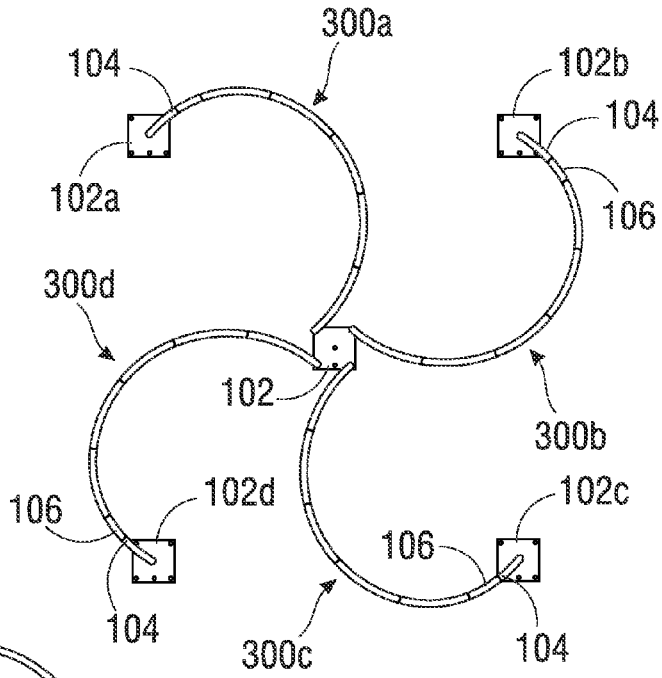
FIG. 4 is a top view of another embodiment of the present invention.
Figure 5:
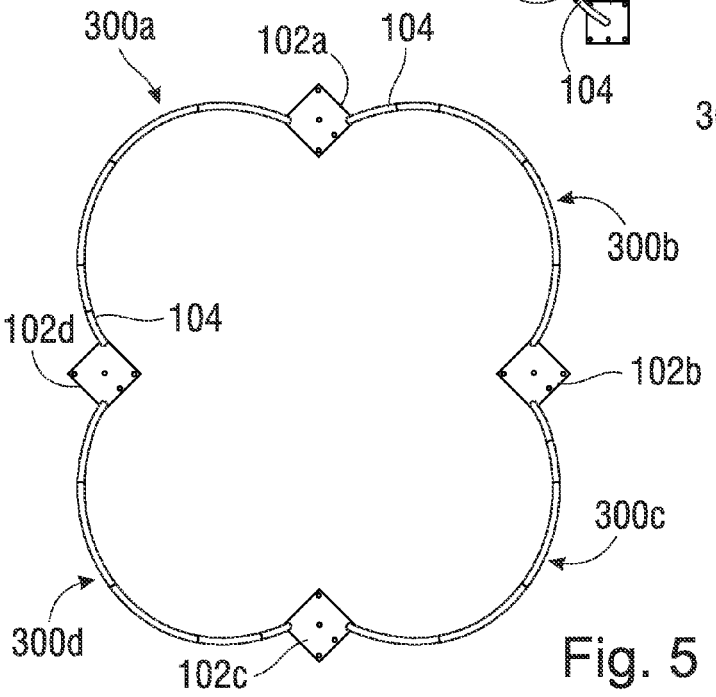
FIG. 5 is a top view of another embodiment of the present invention.

In the preferred embodiment, the mounting pin 122 secures the base plate 102 to a starter pole 104, which then can be secured to extension poles 106, 106*a-e*, as shown in FIG. 1. The mounting pin 122, therefore, provides an important support structure near the base plates 102, stabilizing the decorative system 100 under both indoor and outdoor conditions. The mounting pin 122 and starter pole 104 may be assembled at the center hole 112, or any auxiliary holes, including side holes 114 or corner holes 116*a-d*. The versatility of this arrangement enables the creation of varied geometric forms and combinations of forms, as shown in FIGS. 3-5. The mounting pin 122 is also easily removed from the base plate 102, providing a portable, safe structure that can be customized for different events. Due to the stability of the mounting pin 122, the present invention also enables the formation of very large structures.

In the preferred embodiment, as shown in FIG. 2, the mounting pin 122 is generally an elongated structure, preferably cylindrical in shape, having a first end 124 and a second end 126 opposite the first end 124. The first end 124 has a mounting pin opening 123 so that a fastener 118 may be inserted into the mounting pin 122 from the bottom surface 110 of the base plate 102. Preferably, the mounting pin opening 123 is defined by threaded walls so that a screw may be used to secure the mounting pin 122 to the baseplate 102.

The second end 126 of the mounting pin 122 may be a closed, solid pin, and is designed to connect with a starter pole 104 by a resistance-fit joint. In some embodiments, the second end 126 of the mounting pin 122 may be secured by a facilitating connector 125, such as adhesives, tapes, like Gaffer's tape, wraps, clips, through-pins, magnetically charged composition, and the like, or any other structural component to fasten with a starter pole 104 or create a tight junction between the starter pole 104 and the mounting pin 122. Preferably, the second end 126 has a diameter that is smaller than the diameter at the first end 124. This change in diameter along the mounting pin 122 may be gradual or tapered, or it may be an abrupt change creating a ledge 127.

To use the mounting pin 122, the first mounting pin end 124 is placed on the top surface 111 of the baseplate 102 over one of the holes 112, 114, or 116. A fastener 118 is inserted through the respective hole from the bottom surface 110 of the base plate 102 and into the mounting pin opening 123, thereby securing the base plate 102 to the mounting pin 122. In the preferred embodiment, a washer 120 may separate the mounting pin 122 and the base plate 102. In each case, a washer 120 can be used to facilitate fastening and unfastening of the mounting pin 122 at the top surface 111 of the base plate 102. In some embodiments, the mounting pin 122 may be integrally formed with the baseplate 102.

A starter pole 104 may be mounted onto the mounting pin 122 so that the mounting pin 122 and start pole 104 form a stable attachment. The purpose of the starter pole 104 connection is to provide structural support to the decorative system 100 near the base plate 102, stabilizing the decorative system 100 under both indoor and outdoor conditions. The starter pole 104 is also easily detached from the mounting pin 122, providing a portable, safe structure that can be customized for different events. In the preferred embodiment, the starter pole 104 is a uniformly-shaped cylindrical tube having a first starter pole end 107 and a second starter pole end 108 opposite the first starter pole end 107. In the preferred embodiment, the first starter pole end 107 may have a first starter pole opening 130 substantially similar in size to the dimensions of the second end 126 of the mounting pin 122 so as to enable the starter pole 104 to slide onto the mounting pin 122. In some embodiments, the dimensions may be similar enough to create a resistance fit. In some embodiments, the starter pole 104 may slide onto the mounting pin 122 until the starter pole abuts against the ledge 127 of the mounting pin 122.

Alternatively, the second end 126 of the mounting pin 122 may be exteriorly threaded and the first starter pole end 107 may be interiorly threaded so as to screw onto the mounting pin 122. In some embodiments, these configurations can be reversed so that the first starter pole end 107 can be inserted into or threaded into the mounting pin 122. Securement of the starter pole 104 to the mounting pin 122 may also be assisted by facilitating connectors 125, such as adhesive, tapes, like Gaffer's tape, wraps, clips, through-pins, magnetically charged composition, and the like.

The second starter pole end 108 is configured to attach to the extension poles 106*a-e*. In the preferred embodiment, the second starter pole end 108 may have a second starter pole opening 131 defined by smooth or threaded walls, with a configuration that is substantially similar in size and dimension as the first starter pole end 107 and designed to attach to a first extension pole 106.

The extension poles 106, 106*a-e* extend the starter pole 104 to form larger structures. The extension poles 106, 106*a-e* are also easily disassembled from the starter pole 104 and each other, providing for portable, safe systems that can form very large structures. Floral arrangements, bells, balloons, strings of lights, letters, words, pictures, and the like can be attached directly to the extension poles 106, 106*a-e* to create a decorative assembly.

In the preferred embodiment, the extension pole 106 comprises a first extension pole end 105 with a solid extension pole pin 103 and a second extension pole end 109 with an extension pole opening 113. In the preferred embodiment, the solid extension pole pin 103 of the first extension pole end 105 is configured to attach to the second starter pole end 108, for example, as a splice joint.

Subsequent extension poles 106*a* have the same structural features, comprising a first extension pole end 105*a* with a solid extension pole pin 103*a*, and a second extension pole end 109*a* with a hollow extension pole opening 113*a*. Thus, the subsequent or additional extension poles 106*a-e* are substantially similar to the first extension pole 106 and can form splice joints with each other to continue to extend the length of the assembly.

In the preferred embodiment, the solid extension pole pin 103 of the first extension pole end 105 is configured to attach to the second starter pole end 108. In some embodiments, the second extension pole end 109 may have an opening 113 defined by a threaded or unthreaded wall, like the second starter pole end 108. In some embodiments, the second extension pole end 109 may contain other fastening properties, such as adhesive, snap fit, magnetic properties, and the like. Each interlocking extension pole 106, 106*a-e* can be made out of various elongated materials, such as metal, plastic, wood, and the like.

In the embodiment shown in FIG. 1, the solid extension pole pin 103 of the first extension pole end 105 forms a resistance-fit attachment to the second starter pole end 108 of the starter pole 104. In some embodiments, this connection may be through a magnetic, adhesive, or splice joint interaction. By attaching the first extension pole end 105 of the first extension pole 106 to the second starter pole end 108 of the starter pole 104, the first extension pole 106 also securely fastens to the base plate 102.

Preferably, the diameter of the extension pole 106 is substantially the same as the diameter of the starter pole 104. However, the diameter of the extension pole pin 103 may be smaller than the diameter of the starter pole 104 or the remainder of the extension pole 106. The decrease in diameter may occur gradually with a taper or abruptly, thereby creating a ledge 115 at the first extension pole end 105. When the extension pole pin 103 is inserted into the second starter pole opening 131, the starter pole 104 will abut against the ledge 115 of the extension pole 106. Since the diameters of the extension pole 106 and the starter pole 104 are the same, it will give the appearance of one long pole.

When the first extension pole 106 is securely fastened to the starter pole 104, subsequent extension poles 106*a-e* identical to the first extension pole 106 can then be attached to the first extension pole 106 in series. Preferably, the second extension pole end 109 of the first extension pole 106 is configured to attach to the solid extension pole pin 103*a* of the subsequent extension poles 106*a* by a resistance fit, much like the way the first extension pole 106 attached to the starter pole 104. Like the other identical extension poles 106*a-e*, the first extension pole 106 may use other fastening properties to attach to subsequent extension poles 106*a-e*, such as threaded screw type connection, adhesion, snap fit, magnetic interaction, other mechanical connections, and the like. As shown in FIG. 1, the connection between adjacent extension poles may also be assisted by a facilitating connector 125, such as adhesive, tapes, like Gaffer's tape, wraps, clips, through-pins, magnetically charged composition, and the like. Such facilitating connectors serve to prevent the unwanted disassembly of the poles. In the preferred embodiment, Gaffer's tape is used, as it leaves no adhesive residue when removed. In the preferred embodiment, the attachment of subsequent extension poles 106*a-e* to one another may utilize the same attachment mechanism as described between the first extension pole 106 and subsequent extension poles 106*a-e*. Each step of additional extension pole connection increases the length of the structure and results in a final or last extension pole 106*e* with an open end 113*e*. In the column structure, the open end 113*e* remains free. In an arch structure, a second baseplate 102*a* having a second mounting pin 122*a* can connect to the second extension pole end 109*e* of the final extension pole 106*e* through its open end 113*e*, thereby creating an arched structure.

In the preferred embodiment, the second base plate 102*a* comprises a second center hole 112*a* in addition to a plurality of second auxiliary holes, including side holes 114*a*, corner holes 116*a*', 116*b*', 116*c*', 116*d*', and any other holes on the base plate 102*a*. The second base plate 102*a* may also have a cutout 119*a* to serve as a handle. A second fastener 118*a* may be inserted through the holes on the bottom surface 110*a*, attaching to a washer 120*a* and a second mounting pin 122*a* on the top surface 111*a* so that the second mounting pin 122*a* is securely fastened to the second base plate 102*a* perpendicular to the top surface 111*a*. In addition, these holes may enable fastening of the second base plate 102*a* to wood or other surfaces, providing structural stability. Screws, nails stakes, and the like can be used in any of the unused holes 112*a*, 114*a*, 116*a'-d'* along the second base plate 102*a*, if desired.

Examples of different types of arched structures and combination structures are shown in FIGS. 3-7. As shown in FIG. 3, a second arch 300*a* may be positioned for attachment to the first arch 300 to form twin arches. To provide twin arches, the starter poles 104*a*, 104*b* of the first arch 300 and second arch 300*a* are attached to opposing corner holes of a centrally located base plate 102*a*. Each of the arches is then stabilized by attachment of the first arch 300 to the nearest (or medial relative to the central base plate 102*a*) corner hole of a first peripheral base plate 102*b* and the second arch 300*a* to the nearest (or medial relative to the central base plate 102*a*) corner hole of a third peripheral base plate 102*c*. This allows additional arches to be strung along in a linear fashion. Other holes can be used.

FIG. 4 demonstrates another combination structure which forms a quadruple arch. As shown in FIG. 4, formation of quadruple arches requires a similar attachment scheme as the twin arch structure, where the four corner holes are used to attach four arches to the centrally located base plate 102 at one end, and the opposite ends of the four arches can be attached to four peripheral base plates 102*a-d*. In another arrangement, a rectangular arrangement of four arches can be created by attaching multiple arches 300*a-d* to multiple base plates 102*a-d* in series, as shown in FIG. 5. The various possible combination structures of the present invention are not limited to these examples. Additional poles or kits may be used to make the assembly larger. In addition, the total height of the decorative arch assembly can be adjusted simply by moving one base plate 102 relative to another base plate 102*a*.

Figure 8:
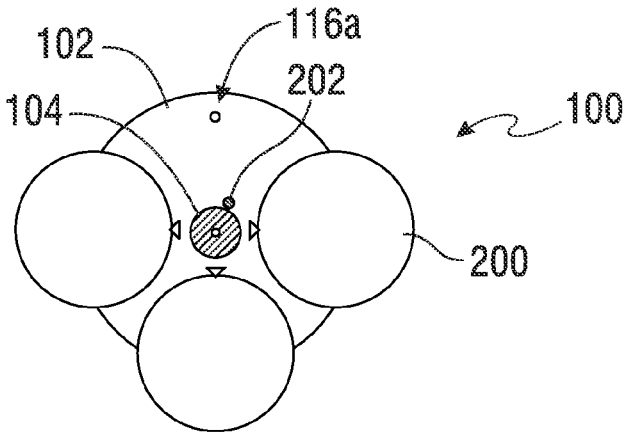
FIG. 8 is a cross-sectional view taken through line 8-8 in FIG. 7, with some balloons removed to display the base plate.

FIG. 6 shows a decorative arch assembly with balloons and FIG. 7 shows a decorative column assembly with balloons. As shown in FIG. 7, the assembled column forms a ninety degree angle with the top surface 111 of the base plate 102. One base plate 102, one starter pole 104, a plurality of extension poles 106, 106*a-e*, and a plurality of balloons 200 are assembled to form the unitary decorative column assembly. FIG. 8 displays a top-down cross-sectional view of the unitary decorative column assembly shown in FIG. 7. Several balloons have been removed from FIG. 8 for clarity.

Attachment of the balloon decorations 200 to the arch and/or vertical column structures can be accomplished by various methods, and can accommodate various geometrical balloon shapes and sizes. In some embodiments, balloon units comprising a plurality of balloon elements are connected annularly on the same plane and may be joined at the center directly to the extension poles 106, 106*a-e* and/or starter pole 104. Alternatively, balloon units may be joined to a secondary balloon attachment line 202, such as rope, wire, monofilament, and the like, attached to the extension poles 106, 106*a-e* and/or starter pole 104. For added security, the attachment line 202 can also be used to attach the poles to the base plate 102. In some embodiments, balloons may be arranged as clusters. In the preferred embodiment, a pole may be passed through the center of each such balloon cluster as the balloon units are mounted on the pole.

Figure 9:
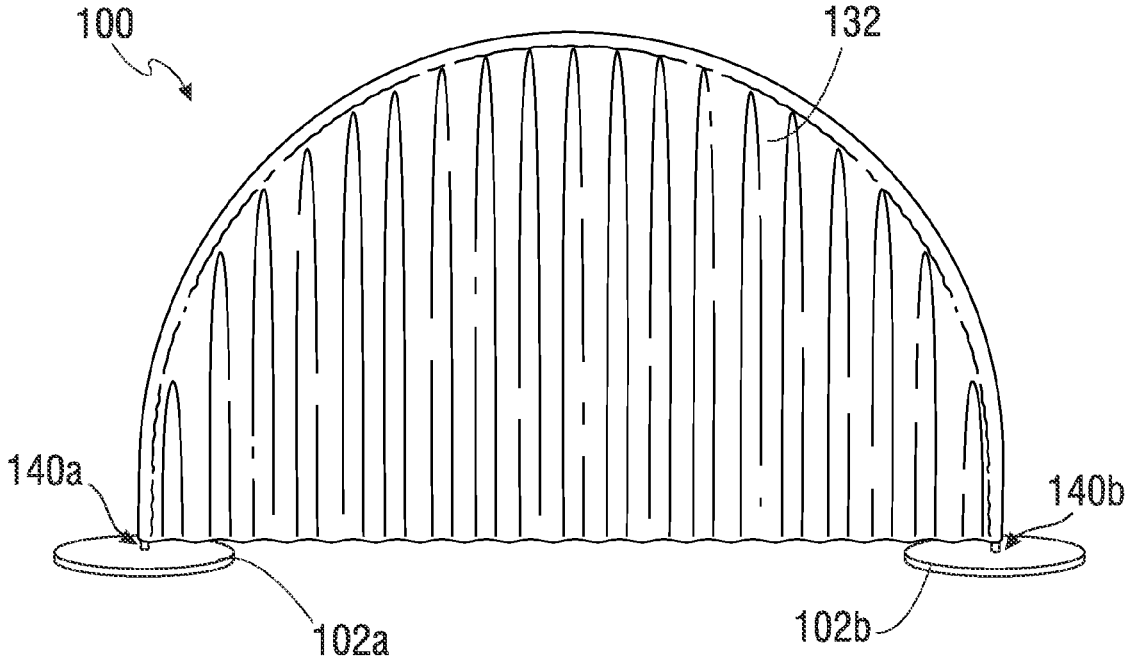
FIG. 9 is a perspective view of an embodiment of a decorative fabric arch assembly.

FIG. 9 discloses an assembled decorative system 100 covered with fabric rather than balloons. In the preferred embodiment of the fabric assembly, a fabric sheet 132 is configured to include an open sleeve which the assembled starter pole 104 and extension poles 106, 106*a-e* may be inserted through. In some embodiments, the fabric sheet may also be sewn directly into pre-fitted slots or holes in the extension poles 106, 106*a-e*, or may attach to the unitary structure by other fastening means. When the center of the assembled arch is raised in height, these attachment methods may facilitate expansion of the fabric sheet. The fabric sheet itself may be made of any material.

In the preferred embodiment, the two side edges 140, 140*b* of each fabric sheet 132 may be provided with fastening means, such as rivets, snaps or mounting bolts, for connection to the base plates 102. In some embodiments, the fabric sheet 132 may hang from the assembled arch like a curtain without fastening the edges of the fabric sheet to their respective base plates 102.

In use, a decoration system 100 can be created by placing a base plate 102 on a ground and fastening a mounting pin 122 to the top surface of the base plate 102. The second starter pole end 108 of a starter pole 104 can be fastened to the first extension pole end 105 of a first extension pole 106. A second extension pole 106*a* can be fastened to the first extension pole 106 by connecting the first extension pole end 105*a* of the second extension pole 106*a* to the second extension pole end 109 of the first extension pole 106. Subsequent extension poles 106*b-e* can be attached in a similar manner to extend the length of the extension poles to a desire length. A decoration, such as balloons or fabric, can be attached to the extension poles. If balloons are used, the balloons can be attached to the poles before or after attaching the poles together. Once all the decorations have been attached, the starter pole 104 can then be attached to the mounting pin 122. Stopping here results in a columned decoration system.

However, if a second base plate 102*a* is placed on the ground, a second mounting pin 122*a* can be fastened to the top surface of the second base plate 102*a* and the second end (109*e* for example) of the last extension pole (106*e* for example) can be attached to the second mounting pin 122*a* of the second base plate 102*a*. Doing so causes the extension poles to create an arch, thereby creating the arched decorative assembly.

Additional base plates 102*b-d* can be placed at desired locations on the ground and additional sets of extension poles creating arches 300 can connect pairs of base plates together to create intricate configuration of arches 300*a-d* as shown in FIGS. 3-5. The decorative system 100 can be provided as a modular kit. By way of example only, the kit may contain two base plates 102, 102*a* that are 24 inch by 24 inch squares, two mounting pins 122, 122*a*, two fasteners 118, 118*a*, two washers 120, 120*a*, one five-foot long starter pole 104, and six five-foot extension poles. Additional extension poles can be purchased separately. One kit may be able to create a thirty-five foot arch. With additional kits or additional extension poles, arches ranging from 25 feet to 50 feet or taller can be easily created. Columns can be as short as 5 feet and as tall as 20 feet or taller.

The foregoing description of the preferred embodiment of the invention has been presented for the purposes of illustration and description. It is not intended to be exhaustive or to limit, the invention to the precise form disclosed. Many modifications and variations are possible in light of the above teaching. It is intended that the scope of the invention not be limited by this detailed description, but by the claims and the equivalents to the claims appended hereto.

What is claimed is:

1. A decoration system, comprising:

a. a first base plate, comprising a top surface, and a bottom surface opposite the top surface;

b. a mounting pin having a first end that is fastenable to the first base plate, and a second end opposite the first end;

c. a starter pole that is attachable to the mounting pin, the starter pole comprising:

i. a first starter pole end; and ii. a second starter pole end opposite the first starter pole end, wherein the first starter pole end is configured to attach to the second end of the mounting pin; and d. a plurality of extension poles, comprising:

i. a first extension pole collinearly attachable to the starter pole; and ii. subsequent extension poles collinearly attachable to a previous extension pole to extend a length of the decoration system, wherein each of the plurality of extension poles comprises a first extension pole end and a second extension pole end, wherein the first extension pole end is configured to attach to the second extension pole end of another extension pole, wherein a last extension pole is attachable to a second base plate, wherein when the last extension pole is detached from the second base plate, the extension poles form a straight column with each extension pole in collinear alignment with an adjacent extension pole, and wherein when the last extension pole is attached to the second base plate, the extension poles form an arching shape without adjusting the attachment in between extension poles.

2. The decoration system of claim 1, wherein the first base plate further comprises auxiliary holes alongside a perimeter of the first base plate.

3. The decoration system of claim 2, further comprising a facilitating connector to secure the first extension pole end to the second starter pole end.

4. The decoration system of claim 2, further comprising an attachment line connected to the extension poles.

5. The decoration system of claim 2, further comprising balloon units arranged as clusters, wherein a pole passes through a center hole of each balloon cluster and the balloon units are mounted on the pole.

6. A decoration system, comprising:

a. a base plate comprising a top surface, a bottom surface opposite the top surface, and auxiliary holes alongside a perimeter of the base plate;

b. a mounting pin having a first end securely fastenable to the top surface of the base plate, and a second end opposite the first end;

d. at least one starter pole, comprising:

i. a first starter pole end and a second starter pole end, ii. wherein the first starter pole end is configured to attach to the second end of the mounting pin, and e. a plurality of extension poles attachable to the starter pole in series at a first attachment point to extend a length of the decoration system, wherein each of the plurality of extension poles comprises a first extension pole end and a second extension pole end, wherein the first extension pole end is configured to attach to the second extension pole end of a previous extension pole at a second attachment point.

7. The decoration system of claim 6, wherein the mounting pin is integrally formed with the baseplate.

8. The decoration system of claim 6, wherein the bottom surface of the base plate is stackable upon a top surface of a second base plate forming a doubly-stacked formation.

9. The decoration system of claim 6, wherein each extension pole forms a resistance-fit attachment at their respective attachment points.

10. The decoration system of claim 6, wherein each extension pole forms a screw type connection at their respective attachment points.

11. The decoration system of claim 6, further comprising a facilitating connector to secure the first extension pole end to the second starter pole end.

12. The decoration system of claim 6, wherein each extension pole forms a magnetic connection at their respective attachment points.

13. The decoration system of claim 6, further comprising balloon units connected circularly on the same plane and joined about an axis of the extension poles.

14. The decoration system of claim 6, further comprising an attachment line connected to the extension poles.

15. The decoration system of claim 6, further comprising balloon units arranged as clusters, wherein a pole passes through a center hole of each balloon cluster and the balloon units are mounted on the pole.

16. The decoration system of claim 6, further comprising a fabric sheet attachable to the extension poles, wherein the fabric sheet includes an open sleeve through which the extension poles may be inserted.

17. A method of creating a decoration system, comprising:

a. placing a base plate on a ground, the base plate comprising a top surface, and a bottom surface opposite the top surface;

b. fastening a mounting pin to the top surface of the base plate;

c. fastening a starter pole to a first extension pole so that the starter pole and the first extension pole are collinear, the starter pole comprising a first starter pole end and a second starter pole end, wherein the first extension pole is fastened to the second starter pole end;

d. fastening a second extension pole to the first extension pole so that the second extension pole and the first extension pole are collinear, wherein the first extension pole, and the second extension pole each comprise a first extension pole end and a second extension pole end, wherein the first extension pole end of the second extension pole is attached to the second extension pole end of the first extension pole;

e. repeating step d by collinearly attaching subsequent extension poles in series to the second extension pole until a desired length is reached;

f. attaching a decoration to the extension poles;

g. fastening the starter pole to the mounting pin, whereby a decoration system is created;

h. placing a second base plate on the ground;

i. fastening a second mounting pin to the second base plate;

j. fastening a last extension pole to the second mounting pin without adjusting connections between adjacent extension poles, whereby a decorative arch is created.

18. The method of claim 17, wherein the decoration is selected from the group consisting of a plurality of balloons and a fabric material.

19. The method of claim 17, further comprising:

a. placing a plurality of base plates on the ground, b. connecting pairs of base plates with each other with a set of collinearly attached extension poles, wherein the set of collinearly attached extension poles connecting the base plates form an arch shape.

20. The method of claim 19, wherein at least one base plate is connected to another base plate via an auxiliary hole along a perimeter of the at least one base plate.

* * * * *